United States Patent [19]

Pitschi

[11] 3,970,355

[45] July 20, 1976

[54] COAXIAL CABLE FITTING

[75] Inventor: Franz Pitschi, Rottach-Egern, Germany

[73] Assignee: Spinner GmbH, Elektrotechnische Fabrik, Munich, Germany

[22] Filed: May 10, 1974

[21] Appl. No.: 468,921

[30] Foreign Application Priority Data

May 15, 1973 Germany ..... 2324552

[52] U.S. Cl. ..... 339/177 R

[51] Int. Cl.[2] ..... H01R 17/18

[58] Field of Search ..... 339/103, 177, 273

[56] References Cited

UNITED STATES PATENTS

| | | | |
|---|---|---|---|
| 3,681,739 | 8/1972 | Kornick | 339/177 R |
| 3,686,623 | 8/1972 | Nijman | 339/177 E |
| 3,757,279 | 9/1973 | Winston | 339/177 R |
| 3,846,738 | 11/1974 | Nepovim | 339/177 R |

OTHER PUBLICATIONS

Western Electric Tech. Digest, Biskup, Coaxial Slip On Connector No. 26, 4/1972, pp. 9 & 10.

*Primary Examiner*—Joseph H. McGlynn
*Attorney, Agent, or Firm*—Ralf H. Siegemund

[57] ABSTRACT

An outer sleeve with connector socket are slipped onto the bared end of a coaxial cable whereby a clamping sleeve with axial slot and conical head is spread radially. The clamping sleeve is resiliently biased so that its head engages a tapered control surface in the outer sleeve tending to clamp the clamping sleeve against the cable end. Frictional engagement of the cable end reinforces that clamping action. The head may either grip the bared outer conductor or an insulation jacket on the cable. The rear portion of the clamping sleeve makes electric contact with the outer conductor of the cable and has contact fingers for making sliding connection with the socket.

20 Claims, 3 Drawing Figures

COAXIAL CABLE FITTING

BACKGROUND OF THE INVENTION

The present invention relates to a fitting for a coaxial cable for providing connection to the inner and/or outer conductors of the cable.

A connector fitting for a coaxial cable is usually clamped to the cable end. Particularly, one uses here a cap screw or flanging to obtain a sufficiently secure connection. The fitting has to be properly positioned, and, usually, the individual parts have to placed individually onto the cable end and are assembled and connected to the cable at the installation site, wherever such a fitting is needed. Both, mechanical positioning and adequate contact making has to be established here during assembly. Installing a fitting is, therefore, a rather cumbersome, time-consuming and expensive procedure and requires considerable skill. The cable end is usually to be stripped, and the outer conductor must often be flanged for appropriate connection with the fitting as it is being assembled.

Coaxial cable is used to an increasing degree in large signal distribution networks such as used for cable TV. Hence, fittings and connections are needed today in large quantities. There is, therefore, a need to simplify the connection of a fitting to the end of a coaxial cable.

DESCRIPTION OF THE INVENTION

It is an object of the present invention to provide for a fitting for coaxial cable ends, which can be preassembled and simply placed onto the cable end.

It is another object of the present invention to suggest a coaxial cable fitting, which can be installed without tools and is composed of only a few parts. Both, fastening to the cable end and electrical contact making must be reliable, even if the connections are not completed individually as part of a local assembly procedure.

In accordance with the principles of the present invention, it is suggested to construct the fitting as automatic, non-return clamp permitting insertion of a cable end but clamping the cable on cessation of insertion with reinforcement of clamping action provided on any attempt to pull the cable out of the fitting. The fitting has an outer sleeve, and a radially effective clamping, preferably frictional surface-to-surface acting device is disposed in that outer sleeve. As a cable is inserted yielding of the clamping device in axial direction is translated into relief of radially effective clamping action, so that insertion can continue; as the end of the cable abuts e.g. at a stop or is just no longer being inserted, the relief ceases and clamping against the periphery of the cable takes place at that point. Any axial return displacement of the cable is translated into clamping reinforcement.

In accordance with the preferred embodiment of the invention, the basic clamping element inside of the outer sleeve is a sleeve or sleeve-like insert which is provided for engagement with the periphery of the exposed, outer conductor of an inserted cable end and has contact elements for making contact with a connector socket or the like. The sleeve or sleeve-like insert can be radially spread and contracted by operation of control surfaces on the inside of the outer sleeve, translating axial disposition of the sleeve or sleeve-like insert into particular radial dimensions.

The outer sleeve contains axially effective resilient means (e.g. a coil spring) biasing the sleeve-like insert in relation to the control surface towards a reduction in diameter of the insert to obtain the radially effective clamping action on a cable when inserted. The axial bias is directed in a direction opposite to the direction of cable insertion, so that upon insertion of the cable end interaction with the sleeve insert tends to displace the insert opposite to the direction of bias thereby spreading the insert radially to overcome any clamping therefrom. Upon cessation of insertion the displacement tendency ceases, and the bias takes over tending to contract the sleeve insert thereby producing clamping.

The fitting can, therefore, be slipped onto a cable end and is positioned therewith. The sleeve insert makes electrical contact with the outer conductor of the cable. If the cable has a rather sturdy outer conductor, such as an aluminum tube or the like, clamping action may be exerted directly onto the tube, and the entire inner surface of the insert may participate in that action. Accordingly, a surface roughness (e.g. grooves, serrations etc) of the sleeve insert may reinforce frictional contact with the inserted outer cable conductor.

The outer conductor may consist of a more delicate foil, in which case only electrical contact with the sleeve insert is desired and clamping action may occur only near the front end of the insert, acting on the outer insulation jacket of the inserted cable, and only a small portion has been stripped of this jacket for electrical contact making with the sleeve insert in the rear of the fitting.

The interacting control surface can be realized by a conical head at the sleeve insert interacting with a corresponding taper inside of the outer sleeve. The sleeve insert is preferably provided with an axial slot, so that its diameter can be changed by widening and narrowing the slot.

The fitting has a contact socket inserted in the outer sleeve and making contact with contacts extending, for example, from the insert. These contacts may be individual fingers which, for example, consist of tangentially extending vanes establishing a circle for contact making larger than the diameter of the insert. The fitting has a cylindrical inner surface which these contact vanes engage for that purpose.

Additionally, an insulative annulus is provided in the socket, and the inner conductor of the coaxial cable is made to project through that annulus for external connection. The socket element is either flanged or releasably connected to the outer sleeve.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates a high frequency cable with an inner conductor 2, an outer conductor 3, an outer plastic jacket 4 and a dielectric filler and spacer 1.

Figure 1:
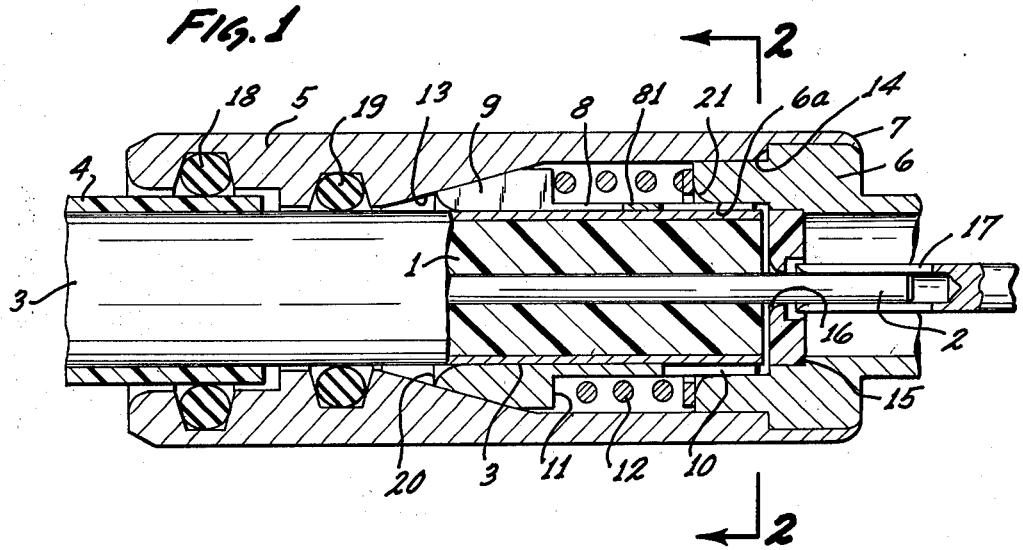
FIG. 1 is a longitudinal section through a high frequency cable with a slipped on fitting in accordance with an example of the preferred embodiment of the present invention.

A fitting is provided and includes an outer sleeve 5 with a connector head or socket element 6 terminating in a plug or socket proper (not shown) to the right of the drawing. The head 6 is connected to sleeve 5 in that the latter has a flanged end or head 7 beaded around an edge of element 6. Alternatively a releasable e.g. threaded connection may be provided for.

An axially slotted clamping sleeve, insert or collet 8 is received by sleeve 5. The slot may extend axially all the way through, but that is not essential in principle. A short bridge 81 may provide contiguous circumferential configuration because only the front end of insert 8 has to be of variable diameter. In such a case multiple slots axial slots can be provided, all extending from the left hand axial end of insert 8 but not all the way through.

Insert or collet 8 has a clamping cone 9 on one end, and tangentially extending integral but twisted vanes 10, resulting from providing axial slots in insert 8 and twisting and straightening the resulting vanes into a tangential orientation. The vanes 10 serve as contact elements, i.e. contact fingers and engage an inner, cylindrical surface 6*a* of socket element 6, from the inside and in resilient engagement therewith, to provide electrical connection and contact making relation therewith. The insert 8 may be axially displaced over a limited range without causing interruption of the electric circuit connection to stationary socket 6.

The inside of insert 8 is serrated or provided with grooves or other surface roughness for increasing friction when seated on conductor 3. This way insert 8 is frictionally held on conductor 3 and makes positive contact therewith. Therefor, positive electrical connection is provided between socket 6 and conductor 3.

The front end of insert 8 is provided with a conical head 9. Cone 9 is wedged against a conical taper 13 inside of sleeve 5. Conical surface of head 9 and taper 13 constitute interacting control surfaces. A spring 12 sits on sleeve 8 and bears against the inner axial end of socket 6 as well as against a rear end shoulder 11 of cone 9, thereby urging cone 9 against inside cone 13 of sleeve 5.

The conical contour of interacting elements 9/13 in combination with the axial slot of clamping sleeve or insert 8 (penetrating also cone 9) translate the axial force of spring 12 into a radial force as between sleeve 5 and insert 8, tending to contract insert 8 radially so that the insert is clamped around and against outer conductor 3 of the cable. Thus, the resilient bias as provided by spring 12, when effective, provides for clamping action in that the cone/ taper interface converts the axial spring force into a radial contraction of slotted insert 8 which is effective as clamp-force when the insert sits e.g. on a cable end as illustrated.

It should be noted that sleeve or insert 8 is per se, axially movable inside of sleeve 5, but inserted spring 12 provides for definite disposition of clamping insert 8 in sleeve 5. The parts 5, 6, 8 and 12 thus constitute a subassembly, which cannot be taken apart due to flanging of part 6 and 7 on the one hand, and the taper 13 on the other hand.

When not seated on a cable, spring 12 pushes the insert forward until the taper cone interaction causes the axial slot of insert 8 to close. As a consequence, the inner diameter of sleeve 8 decreases (at least near the end carrying head 9) and is selected to be smaller than the outer diameter of outer conductor 3 of a cable. The inner diameter of insert 8 adjacent bridge 81 matches that of the conductor 3, but even a loose fit could be provided here.

The front end of head 9 is provided with a flared entrance 20. The front end of the cable engages this flared entrance 20 pushing the insert, in the drawing, to the right against the force of spring 12. Since the head 9 recedes from its position on taper 13 interaction between the inserted cable end and the flared head end 20 tends to radially spread the insert 8. Thus, upon inserting a cable into sleeve or insert 8, the slot in insert 8 may spread, and the diameter of sleeve head 9 increases; the cable is now actually being inserted into insert 8.

The friction of the cable end against the roughened inner surface of insert 8 tends to move that insert to the right, the spring tends to move the insert to the left so that in balance the cable can be inserted if moved sufficiently strong to overcome the friction. Thus, the insertion as such offsets clamping action by the insert because the tendency to hold insert 8 to the right by frictional insertion means that the head 9 as urged to the left by the spring is held against the taper and at a sufficiently large diameter of insert 8 so that clamping action is not provided.

Insertion continues (for all practical purposes) until the cable ends about the insulating barrier 15. As soon as insertion ceases, the continued tendency of spring 12 to wedge cone 9 against taper 13 under reduction of the diameter of insert takes over to decrease the inner diameter of head 9 and that tendency reinforces frictional engagement with the cable and provides for clamping. If for some reason an attempt is made to pull the cable out of the fitting (including any accidental pulling prior to complete insertion), friction between insert 8 and the cable tends to take the insert 8 along, and that in turn re-inforces the clamping action because such a displacement of head 9 in relation to taper 13 cause insert 8 to reduce its diameter.

After the cable is placed securely into insert 8, the latter makes intimate contact with the outer conductor 3 of the former. As stated the vanes provide for intimate contact with the socket element 6. Hence, a positive contact making and electrically conductive connection is established between the outer conductor of the cable and socket element 6.

As far as the inner conductor 2 is concerned, it projects through insulative annulus 15 in spaced-apart and insulated relation to socket element 6. Annulus 15 is also provided with a curved or inwardly flaring lip 16 to facilitate insertion of conductor 2. The conductor 2 as projecting through and outwardly from annulus 15 is received in a socket element 17 leading to or pertaining to the plug element whose outer conductor pertains to or makes contact with element 6.

The outer insulation 4 of the cable has been stripped off the end of the outer conductor 3, but not too far. Sleeve 5 projects sufficiently far to receive also the end of the insulation jacket 4. Sleeve 5 is provided with a first groove, close to the end, and on the inside thereof. An O-ring 18 is disposed in that groove and sealingly bears against insulation 4, when the cable is inserted. A second inside groove in sleeve 5, more on the inside thereof, receives another O-ring, 19, being of somewhat smaller diameter than ring 18, and the latter bears sealingly against the bared outer conductor 3.

Prior to utilization, the insert 8 should not be permitted to have its diameter reduced too much as that may prevent simple slip-on onto the cable end. This depends, of course, to some extent on the width of the axial gap and slot in insert 8. If that gap is rather wide, complete closing may be undesirable as that may reduce the diameter of insert 8 too much. Thus, the axial advance of head 9 (which is responsible for the radial contraction of the insert) may be arrested in that, a small shoulder or stop 20 may be provided on the taper 13 to prevent too far advance of the front end of sleeve 8 - cone 9 under the expansion force of spring 12.

An annular washer 6a may be interposed between the inner axial end of socket 6 and the spring. That axial end of the socket is also provided with a flared entrance 21, aiding in the cable insertion as well as for the insert 8 during initial assembly of the parts of the fitting. The annulus **6*a* provides a more planar surface for engagement with spring 12.**

In order to prevent rotation of sleeve or insert 8 inside of outer sleeve 5 a radially inwardly extending lug **5*a* may reach into the slot in sleeve 8** to prevent its turning.

Figure 3:
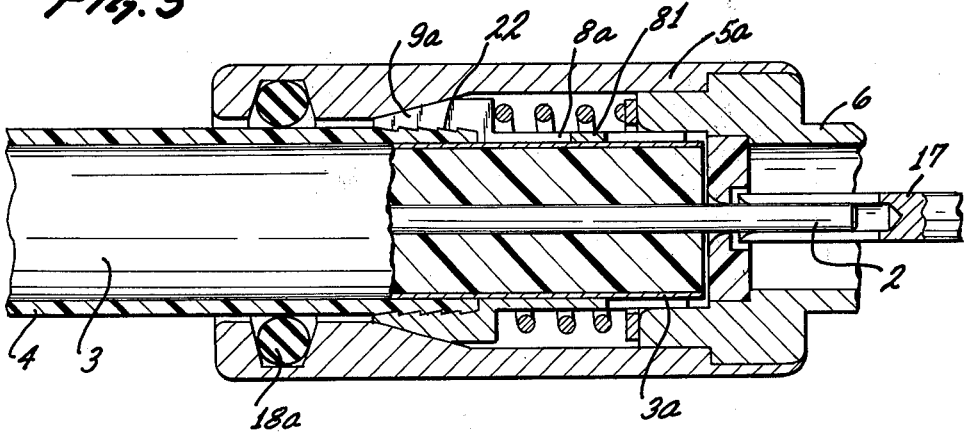
FIG. 3 is a section view similar to FIG. 1, but with clamped on fitting.

Turning now to FIG. 3, the fitting shown there is particularly designed for connection to a cable having an outer conductor **3*a*** which is a thin foil or sheath. Such a foil is inherently endangered to being damaged, so that its surface must be subjected to clamping action by the fitting.

A clamping sleeve and insert **8*a* is provided also here, but its front cone 9*a* is designed for extending to and over the insulation 4 and for engagement therewith. Hence, gripping and mechanical interaction does not affect the foil 3*a* directly, only its outer plastic (synthetic) jacket 4** which is provided for protection and must be able to withstand clamping action.

The surface of the bore traversing cone **9*a* is provided with sawtooth-like serrations 22 of such orientation that the teeth do not resist slip-on of the fitting onto the cable, but retraction is impeded by the steep flanks of the teeth. The teeth 22 engage positively the insulation of sheath 4** in fish hook fashion.

Figure 2:
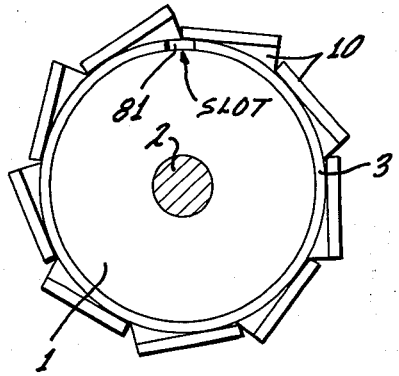
FIG. 2 is a section along line 2—2 in FIG. 1.

Electric contact is made between parts as outlined above. In other words, the rear end of sleeve 8a and the socket element 6 can be constructed as in FIG. 2, and FIG. 2 could be interpreted as an analogous view in FIG. 3 except that the outer conductor is thinner.

As one can see in FIG. 3 the bridge 81 across the slot (or one of the slots) is also provided for insert 8. Such connection has added significance here as the radial action of head **9*a* is on a lever action basis. The radial displacement for radial clamping action against insulation 4 by the head area is larger than radial displacement of insert 8*a* near bridge 81 for gentle contact making between insert 8*a* and outer conductor foil 3*a*; the bridge 81** serves as fulcrum.

A single O-ring **18*a* is provided in a groove of outer sleeve 5*a* for sealingly engaging the insulation jacket. The engagement between the serrated surface of head 9*a* and the insulation jacket 4 provides for additional sealing as between the exposed conductors of the cable and the interior of the insert 8*a*** on the one hand, and the exterior on the other hand.

The invention is not limited to the examples outlined above, but the following modifications are readily available. For example, in lieu of vanes of the type shown in FIG. 2, one can employ other known varieties of contact elements such as rings having slotted configuration and radially resilient contact elements, whereby contact fingers are used also for engagement with the outer conductor of the cable. This is particularly of interest for the example of FIG. 3 as even more gentle contact making and engaging with foil **3*a*** is available under such circumstances.

The preferred embodiment of the invention operates with a clamping sleeve having a conical head. One can, however, use other clamping devices using pivotable clamping elements or constructions analogous to one way clutches and free wheeling in one direction modified for linear rather than rotational one-way motion to be permitted.

The sleeve 5 is connected to socket element 6 by means of the flanged edge 7. The connection can be made in other ways instead, including a releasable threaded connection if it is to be expected that the fitting has to be disconnected from the cable for any reason.

The invention is not limited to the embodiments described above all changes and modifications thereof not constituting departures from the spirit and scope of the invention are intended to be included.

I claim:

1. Hf cable fitting for connection to the end of a coaxial cable;

a sleeve member for slipping onto and over the end of a cable in axial direction and including an internal control surface;

clamping means disposed in the sleeve member for axial movement therein and cooperating with said control surface to contract radially inwardly as a radially inwardly acting clamp when in axial forward positions, while permitting radial outward spreading when moved from the forward positions in a particular axial direction colinear with the axial direction of insertion of a cable in the sleeve;

resilient means acting axially on the clamping means and causing the clamping means to assume one of said forward positions;

the clamping means constructed for engagement with the periphery of an axially inserted cable thereby causing the clamping means to be moved from the forward positions against the bias of the resilient means, upon cessation of the insertion of the cable the resilient means moving the clamping means back into one of the forward positions and holding it in one of the forward positions, whereby engagement of the clamping means with said control surface provides for the radially inwardly directed clamping action against and of the insert cable, the resilient means providing clamping force for obtaining said clamping action; and connecting means in the sleeve member to make contact with an exposed peripheral portion of said cable.

2. Fitting as in claim 1, wherein the inserted cable engages the clamping means frictionally for moving it in the said axial direction.

3. Fitting as in claim 1, wherein the clamping means is an axially biased, axially slotted sleeve having a conical head, the control surface being defined by a taper surface in the sleeve member acting on the head for azimuthally spreading or contracting the slotted sleeve depending on the disposition of the head in the sleeve member, the slotted sleeve frictionally engaging at least a portion of the cable end.

4. Fitting as in claim 3, wherein only the head end portion of the slotted sleeve has internal means for engaging the cable in a surface deforming manner, the cable having an insulation jacket, stripped only to the extent of contact making of the slotted sleeve at the end thereof opposite the head end.

5. Fitting as in claim 3, wherein the connecting means includes a socket in the sleeve member at one end thereof, and contacts extending from the slotted sleeve and engaging the socket.

6. HF cable fitting for connection to the end of a coaxial cable having inner and outer conductors, the outer conductor being exposed at the end of the cable, comprising:

an outer sleeve for slipping onto and over the end of the cable and having a tapered surface on the inside;

connecting means in the outer sleeve for making electrical connection with the outer conductor of the cable when inserted;

an axially slotted clamping sleeve axially movably disposed in said outer sleeve and constructed for axial displacement upon insertion of a cable without requiring turning, said clamping sleeve having a conical head interacting with the tapered surface for widening or narrowing the slot or slots of the clamping sleeve;

a spring in the outer sleeve and held on one side in relation to said outer sleeve, while acting with the other side on the clamping sleeve for biasing the clamping sleeve in an axial direction, opposite an axial direction of insertion of the cable into the outer sleeve and into the clamping sleeve, thereby causing the clamping sleeve to exert radially inwardly directed clamping pressure for action on the circumference of the inserted cable; and the slot or slots of the clamping sleeve providing for radial expansion upon insertion of the cable and upon axial displacement of the clamping sleeve in the direction of insertion and against the bias of the spring, so that the insertion is not impeded by clamping pressure, the spring causing the clamping sleeve to provide the said clamping pressure upon cessation of insertion.

7. Fitting as in claim 6, wherein the conical head has a shoulder, the spring being a coil spring on the sleeve acting on the shoulder.

8. Fitting as in claim 6, wherein the head end of the clamping sleeve where facing the cable when inserted has a flared contour so that the cable end can radially spread the slotted sleeve.

9. Fitting as in claim 6 including means for impeding turning of the clamping sleeve in the outer sleeve.

10. Fitting as in claim 6, wherein the interior of the front end of the clamping sleeve is provided with serrations for engagement with an insulation cover of the inserted cable.

11. Fitting as in claim 6, wherein the outer sleeve has at least one internal groove, a sealing O-ring in said groove for sealing engagement with the inserted cable.

12. Fitting as in claim 6, wherein the clamping sleeve is provided with contact elements extending from one end of the clamping sleeve, the connecting means being a socket member in the sleeve member, the socket member engaging the contact elements.

13. Fitting as in claim 12, wherein the contact elements are fingers extending from the sleeve.

14. Fitting as in claim 12, wherein th socket member has a cylindrical surface for sliding engagement with the contact elements permitting relative movement between the elements and the surface.

15. Fitting as in claim 12, wherein the socket member is provided with an insulative annulus, the inner conductor or the inserted cable projecting through said annulus.

16. Fitting as in claim 12, wherein the clamping sleeve is provided on its interior surface with surface-roughness for increasing friction with the inserted cable.

17. Fitting for connection to the end of a coaxial cable having an inner and an outer conductor, to be positioned thereon and for making contact with the outer conductor, comprising:

a first sleeve for insertion of the end of the cable and having an internal control surface;

an axially slotted, second sleeve, axially displaceably retained in said first sleeve and having a control surface for engagement with the control surface of the first sleeve so as to determine radial dimensions of the second slotted sleeve in dependence upon relative axial disposition of the second slotted sleeve in the first sleeve;

resilient means biasing the second slotted sleeve in a first axial direction, opposite to a direction of insertion of the cable into the first sleeve tending to reduce the radial dimensions of the second slotted means by operation of engagement between the control surfaces;

the cable when inserted engaging the second slotted sleeve and tending to displace and displacing the second slotted sleeve axially on account of its axial displaceability opposite to the first direction and against the bias by the resilient means, so that the radial dimensions of the second slotted sleeve are increased, upon completion of insertion the resilient means biasing the second slotted sleeve, so that the engaging control surfaces tend to reduce the radial dimensions of the second slotted sleeve; and means included in the second slotted sleeve and provided for frictional engagement with the inserted cable and holding the cable by operation of the resilient means as biasing the second slotted sleeve.

18. Fitting as in claim 17, the slotted sleeve having a conical head constituting the control surface thereof, the first sleeve having a corresponding conical control surface.

19. Fitting as in claim 17, the resilient means being a coil spring acting on the first sleeve.

20. Fitting as in claim 17, second sleeve provided with contact elements, the first sleeve having a contact socket said socket engaging the contact elements, the inner conductor of the inserted cable being guided through the contact socket in insulated relation thereto.

* * * * *